United States Patent [19]

Pinson

[11] 4,158,845

[45] Jun. 19, 1979

[54] NON-GIMBALED POINTER AND TRACKING PLATFORM ASSEMBLY

[75] Inventor: George T. Pinson, Huntsville, Ala.

[73] Assignee: The Boeing Company, Seattle, Wash.

[21] Appl. No.: 891,982

[22] Filed: Mar. 31, 1978

[51] Int. Cl.² ..... H01Q 3/10

[52] U.S. Cl. ..... 343/759; 74/86

[58] Field of Search ..... 343/759, 763–766; 74/86, 491, 501 M

[56] References Cited

U.S. PATENT DOCUMENTS

| | | | |
|---|---|---|---|
| 2,528,963 | 11/1950 | Looney | 343/763 |
| 2,762,234 | 9/1956 | Dodd | 343/765 |
| 3,225,611 | 12/1965 | Alder et al. | 343/761 |
| 3,589,208 | 6/1971 | Brero | 343/491 |

*Primary Examiner*—Eli Lieberman

*Attorney, Agent, or Firm*—Thomas H. Murray

[57] ABSTRACT

A low-cost mechanical pointing and tracking platform that does not use gimbals and to which a sensor may be attached for use in searching an area for a target located at some unknown point. This is achieved with the use of a shaft, mounted intermediate its ends in a ball and socket joint and carrying at its forward end a platform for mounting a sensor. The other end of the shaft passes through a radial slot in a first rotatable member and extends into a spiral groove in a second rotatable member coaxial with the first. By manipulating the rotation of the two members, the sensor can be made to scan a circular, conical, spiral, linear or any other fixed or programmed complex pattern, can locate a target at any point in a two-dimensional field of view and can be made to track a target once it is detected.

9 Claims, 5 Drawing Figures

NON-GIMBALED POINTER AND TRACKING PLATFORM ASSEMBLY

BACKGROUND OF THE INVENTION

In the past, radar antennas and other sensors which must locate a target at any point within a field of view have often been mounted on multi-gimbaled platforms. In an arrangement of this sort, two gimbals, rotatable about perpendicular axes, are driven by servomotors to scan an area and align the sensor with a detected target. The system requires that the servos be driven by a controller that generates a preprogrammed sequel of commands or generates necessary commands based on some feedback system. While used extensively, multi-gimbaled arrangements of this sort are not altogether satisfactory since they require precisely calibrated electrical torquers to maintain knowledge of sensor direction and position and also require a complex controller to determine the fractional motion by each servo. The most significant disadvantage, however, is the required precision of the device and its associated cost, weight and complexity.

Other attempts at mounting radar antennas and the like have used azimuth/elevation or generically similar mounts. These employ an azimuth drive for alignment in the reference plane and an elevation drive which positions the sensor at an angle measured from the reference plane to the line of sight of the sensor. These systems, however, still require at least one gimbal and the use of precision gearing with anti-backlash provisions, making them bulky and expensive.

SUMMARY OF THE INVENTION

In accordance with the present invention, a new and improved tracking platform assembly for sensors is provided which eliminates the problems associated with prior art platforms of this type in that it does not employ gimbals. In this regard, the platform of the invention is simpler and less expensive than prior art tracking platforms.

Specifically, the invention includes a mounting plate for a sensor, a shaft secured at one end to the mounting plate, and means mounting the shaft intermediate its ends for simultaneous movement in two directions whereby the axis of the shaft can be made to intersect any point in a field of view. Preferably, this mounting means comprises a ball and socket joint. Positioned on the side of the ball and socket joint opposite the mounting plate is a rotatable plate having a face formed with a generally spiral groove which receives the end of the shaft opposite the mounting plate. A second rotatable member is carried between the plate and the ball and socket joint and is carried for rotation about an axis extending through the central axis of the spiral groove in the first plate as well as the center of the ball and socket joint. A slot is provided in this second member which extends radially outwardly from its axis of rotation and through which the shaft extends. By separately and independently rotating the respective plates, spiral, conical or linear movement of the platform can be achieved.

Preferably, the two rotatable members are controlled by stepping motors which, in turn, respond to stepped commands from a digital control system which incorporates means for tracking a target once detected within the field of view of the sensor.

The above and other objects and features of the invention will become apparent from the following detailed description taken in connection with the accompanying drawings which form a part of this specification, in which.

Figure 1:
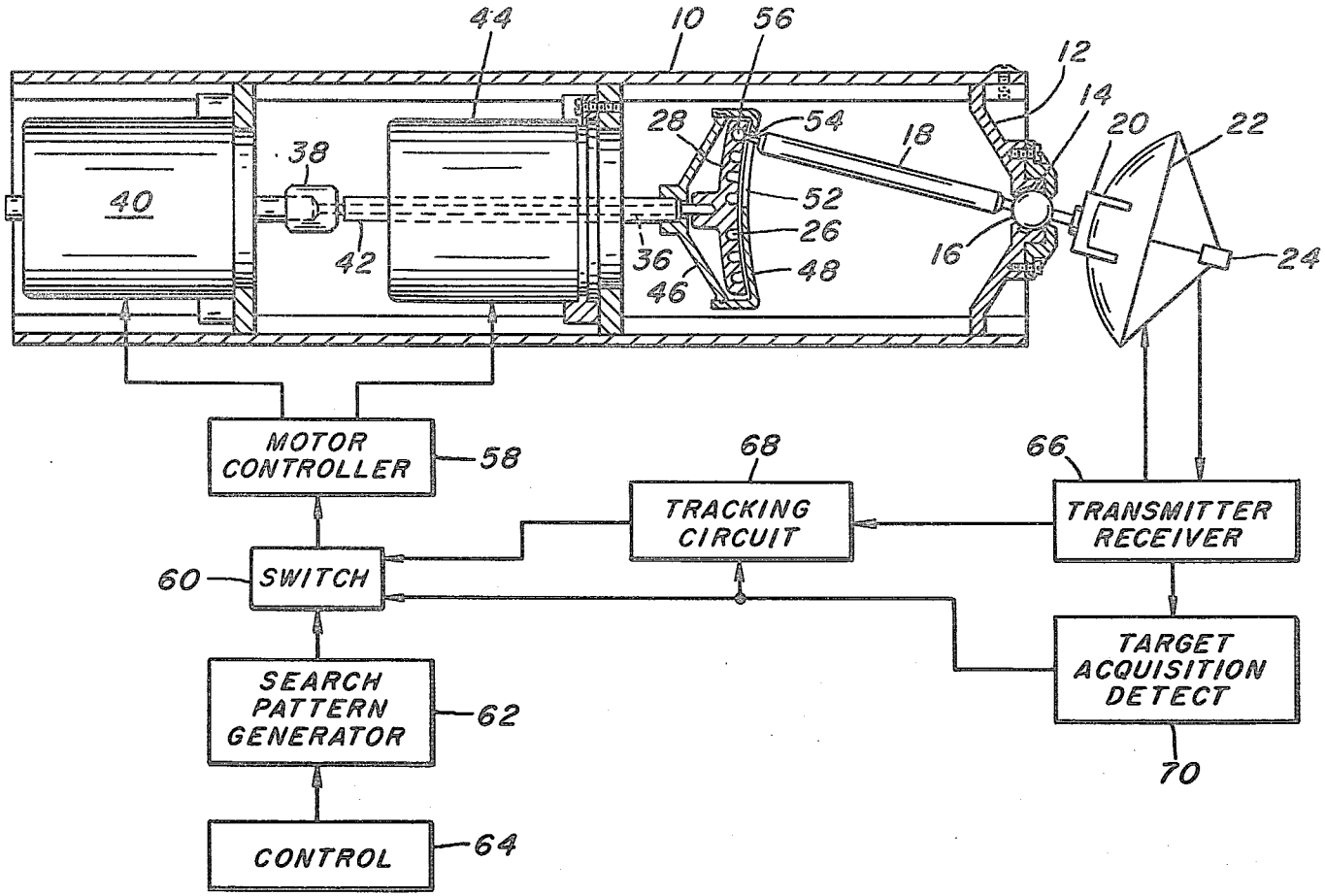
FIG. 1 is a schematic diagram of one embodiment of the invention as applied to an automatic tracking radar.

With reference now to the drawings, and particularly to FIG. 1, the apparatus shown includes an outer housing 10, preferably cylindrical in cross-sectional configuration, which carries at its forward end a spider assembly 12. Centrally disposed on the spider assembly 12 is a socket 14 which receives a ball 16 forming an integral part of a shaft 18, the arrangement being such that the forward end of the shaft can be simultaneously moved in azimuth and elevation. A pin may be incorporated in socket 14 that fits in a slot in ball 16 to restrict rotation of the sensor 22. The forward end of the shaft 18 carries a mounting plate 20 which, in the embodiment of the invention shown in FIG. 1, supports a radar antenna 22 having a forward, feed horn assembly 24. It will be understood, of course, that instead of using a radar antenna, an infrared or other type sensor can be used equally well. The other end of the shaft 18 is carried within a spiral or curved slot 26 formed in a rotatable plate 28.

Figure 3:
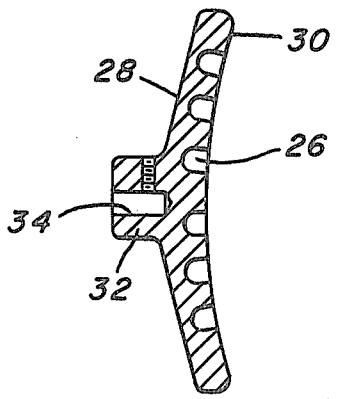
FIG. 3 is a cross-sectional view taken along line III—III of FIG. 2.
Figure 2:
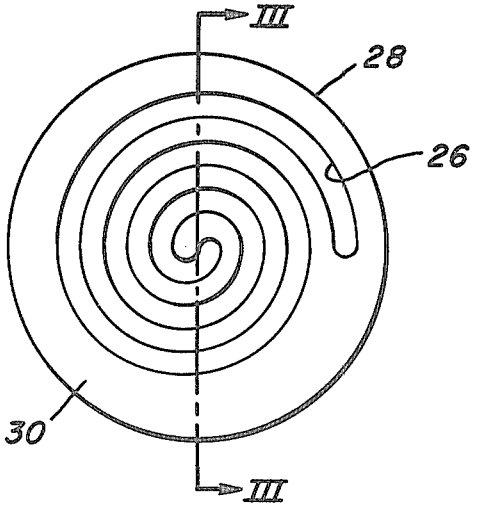
FIG. 2 is an elevational end view of one or two rotatable plates used to control the tracker platform of the invention and incorporating a spiral groove in one face thereof.
Figure 4:
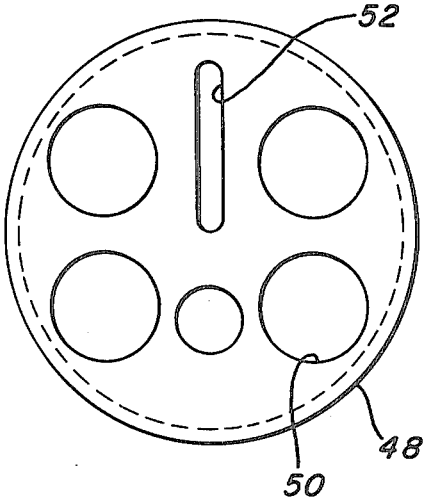
FIG. 4 is an elevational end view of the other rotatable member of the invention for controlling the tracker platform and incorporating a radial slot through which a shaft which carries the tracking platform extends.

The details of the plate 28 are shown in FIGS. 2 and 3. It will be noted that the spiral groove 26 is formed in a forward, concave face 30. The plate 28 is provided with a boss 32 having a bore 34 therein which receives a drive shaft 36 (FIG. 1) coupled through coupling 38 to a first stepping drive motor 40. The shaft 36 extends through a hollow drive shaft 42 for a second stepping drive motor 44. The hollow drive shaft 42, in turn, is connected to a generally conical spider element 46 connected at its outer periphery to a slotted disc 48. With reference to FIG. 4, it will be noted that the disc 48, which also has a concave forward surface, is provided with circular openings 50 therein, the purpose of these openings being only to reduce the weight of the disc. Also formed in the disc 48 is a radially-extending slot 52 through which a reduced diameter end 54 of the shaft 18 extends (FIG. 1). The reduced diameter end 54 has a spherical element 56 which rides within the spiral slot 26 in plate 28.

If it is assumed that the plate 48 is stationary while the plate 28 rotates, the line of sight of the antenna 22 will move along a linear path, as guided by the slot 52, as the shaft 18 moves radially inwardly or outwardly upon rotation of the plate 28 in one direction or the other. On the other hand, if the forward plate 48 rotates while the slotted plate 28 remains stationary, the line of sight of the antenna 22 will scan a spiral pattern. Finally, if both plates 28 and 48 rotate in the same direction at the same speed, the line of sight of the antenna 22 will perform a conical scan at an angle determined by the radial distance of the spherical end 56 from the center of rotation of plates 28 and 48. Furthermore, it will be appreciated that by appropriate rotation of the two plates 28 and 48 in one direction or the other, the line of sight of the antenna 22 can be moved to any point in a two-dimensional field of view.

The two stepping motors 40 and 44 are connected to a motor controller circuit 58 (FIG. 1) which is, in turn, connected through switch 60 to a search pattern generator 62 controlled by a control 64. With this arrangement, the antenna 22 will perform a conical, spiral or linear searching pattern as determined by the control 64. As was mentioned above, a spiral scan is achieved by rotating plate 48 while plate 28 is stationary. To achieve a conical scan, plate 28 is initially rotated to move the spherical end 56 radially outwardly or inwardly to a desired position, whereupon both plates 28 and 48 are rotated in the same direction at the same speed. As will be understood, the ball and socket joint 14, 16 permits universal movement of the line of sight of the antenna 22 to any point in a field of view.

The antenna 22 is connected to a receiver-transmitter 66 as is conventional, the transmitter 66 being connected to a tracking circuit 68 as well as a target acquisition detecting circuit 70. When a target is detected during scanning of the antenna 22, the tracking circuit 68, which may be conventional prior art design, is activated and the switch 60 is caused to disconnect the search pattern generator 62 from the motor controller 58 and connect it to the tracking circuit 68. In this manner, the antenna will continuously track the target until commanded otherwise.

Figure 5:
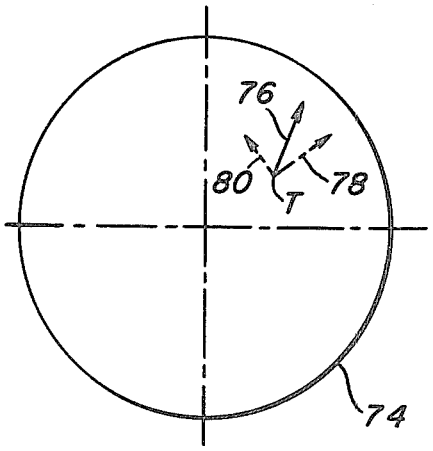
FIG. 5 is an illustration of the field of view of the tracker of the invention which vectorially explains how a target is tracked.

The action of the apparatus in tracking a target is illustrated in FIG. 5 wherein the maximum field of view of the line of sight of the antenna 22 is indicated by the circle 74. It will be assumed, for example, that a target T is moving in the direction of the vector 76 at a speed proportional to the length of the vector. This can be broken down into two right angles vectors. Thus, vector 78 extends along the radius of the field of view; and vector 80 is at right angles thereto. Vector 80 is also tangent to a circle having a center coincident with the center of the field of view 74 and a radius equal to the distance of the target T from the center of the field of view. It will be appreciated that by rotating the plate 28 such that the antenna will move outwardly at a speed corresponding to vector 78, and rotating the slotted plate 48 such that the tangential speed of the line of sight of the antenna is equal to that of vector 80, the target can be continuously tracked. As the course of the target varies, the tracking circuit 68 will automatically control the stepping motors 40 and 44 to follow the target.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. Apparatus for mounting a sensor adapted to search an area in two dimensions for a target located at some unknown point, comprising a mounting plate for said sensor, a shaft secured at one end to said mounting plate, means mounting said shaft intermediate its ends for simultaneous movement in two directions whereby the axis of said shaft can be made to intersect any point in a field of view, a rotatable plate having a face formed with a generally spiral groove which receives the end of said shaft opposite said mounting plate, a member between said plate and mounting means and carried for rotation about an axis extending through the central axis of said spiral groove, a slot in said member extending radially outwardly from the axis of rotation of the member and through which said shaft extends, and separate means for independently rotating said plate and said slotted member.

2. The apparatus of claim 1 wherein said means mounting said shaft intermediate its ends comprises a ball and socket joint suitably pinned to prevent rotation about its longitudinal axis.

3. The apparatus of claim 1 wherein the face of said rotatable plate is generally concave in configuration and said generally curved or spiral groove that is at near right angles to the slotted member for any relative rotation between the two is formed in said concave face.

4. The apparatus of claim 3 wherein said member carried for rotation is dish-shaped in configuration to conform to the concave face on said rotatable plate.

5. The apparatus of claim 1 wherein said rotatable plate and said member carried for rotation are rotatable about coaxial axes.

6. The apparatus of claim 5 wherein said rotatable plate is connected to a shaft and said member mounted for rotation is connected to a tubular shaft surrounding said first-mentioned shaft.

7. The apparatus of claim 6 wherein said separate means for independently rotating said plate and said slotted member comprises axially-aligned first and second motors.

8. The apparatus of claim 7 wherein said motors comprise stepping motors, and including digital control means for said stepping motors.

9. Apparatus for simultaneous movement of an element in two dimensions, comprising a mounting plate for said element, a shaft secured at one end to said mounting plate, means mounting said shaft intermediate its ends for simultaneous movement in two directions whereby the axis of said shaft can be made to intersect any point in a two-dimensional field of view, a rotatable plate having a face formed with a generally spiral groove which receives the end of said shaft opposite said mounting plate, a member between said plate and mounting means and carried for rotation about an axis extending through the central axis of said spiral groove, a slot in said member extending radially outwardly from the axis of rotation of the member and through which said shaft extends, and separate means for independently rotating said plate and said slotted member.

* * * * *